US007222747B1

(12) United States Patent
Savran

(10) Patent No.: US 7,222,747 B1
(45) Date of Patent: May 29, 2007

(54) MULTI-FUNCTION SANITIZATION SYSTEM

(76) Inventor: Doreen Savran, 16 Eastern La., New Milford, CT (US) 06776

( * ) Notice: Subject to any disclaimer, the term of this patent is extended or adjusted under 35 U.S.C. 154(b) by 107 days.

(21) Appl. No.: 10/977,996

(22) Filed: Oct. 29, 2004

(51) Int. Cl.
*B65H 1/00* (2006.01)

(52) U.S. Cl. ..... 221/34; 221/45; 221/97

(58) Field of Classification Search ..... 312/34.4, 312/34.8, 34.9, 34.23, 34.1, 290, 245, 345, 312/228, 229, 250; 221/41, 42, 45, 96, 97, 221/100, 102, 185; 220/23.83, 908, 23.86, 220/475, 480; 248/149, 132, 311.2, 127; 206/225, 229, 233, 576, 389, 408, 409, 494, 206/823; 280/47.19
See application file for complete search history.

(56) References Cited

U.S. PATENT DOCUMENTS

| | | | | |
|---|---|---|---|---|
| 3,573,879 | A * | 4/1971 | Bergkamp et al. | 280/47.19 |
| D273,147 | S * | 3/1984 | Iverson | D34/6 |
| 4,540,107 | A * | 9/1985 | Davidson | 221/194 |
| 4,788,909 | A | 12/1988 | Stewart | 100/102 |
| 5,244,220 | A * | 9/1993 | Cortez | 280/47.26 |
| D340,374 | S | 10/1993 | Hines | D6/519 |
| 6,332,554 | B1 * | 12/2001 | McCarthy | 220/554 |
| 6,508,383 | B2 | 1/2003 | Lidahl et al. | 221/97 |
| 6,691,897 | B2 | 2/2004 | Ashe | 222/174 |
| 6,905,039 | B2 * | 6/2005 | Richter et al. | 220/23.83 |
| 2003/0076013 | A1 | 4/2003 | Kauzlarich et al. | 312/34.4 |

* cited by examiner

*Primary Examiner*—Gene O. Crawford
*Assistant Examiner*—Timothy Waggoner
(74) *Attorney, Agent, or Firm*—Sturm & Fix LLP

(57) ABSTRACT

A sanitization system (10) for storing and dispensing a variety of sanitizing and cleaning supplies such as paper towels (70), tissues (80), anti-bacterial liquids (60) and spray bottle cleaners (90) wherein, the system (10) includes a housing member (20) having a rear panel (21) and a base (23) connected to a pair of side panels (24) (25) wherein, one of the side panels (25) is provided with an apertured pivoted front panel (26) and the rear panel (21) has a pivoted cover element (28) that overlaps the front cover (26).

Furthermore, the housing member (20) has an interior vertical panel (30) having inwardly directed segments that form upper (32) and intermediate (31) shelves wherein, the intermediate shelf (31) cooperates with an elongated vertical opening (27) in the other side panel (24) to form a pair of side storage compartments.

19 Claims, 1 Drawing Sheet

MULTI-FUNCTION SANITIZATION SYSTEM

BACKGROUND OF THE INVENTION

1. Field of the Invention

The present invention relates to the field of sanitizing systems in general and in particular to a self contained point of use sanitizing system that limits the potential of cross-contamination of the sanitizing supplies employed in the system.

2. Description of Related Art

As can be seen by reference to the following U.S. Pat. Nos. 6,691,897; 6,508,383; 4,788,909; and Des. 340,374, the prior art is replete with myriad and diverse cleaning sanitizing systems.

While all of the aforementioned prior art constructions are more than adequate for the basic purpose and function for which they have been specifically designed, they are uniformly deficient with respect to their failure to provide a simple, efficient, and practical multi-function sanitizing system that is contained within a single housing component that substantially restricts the access of the public to the cleaning supplies contained within the housing component.

While U.S. Pat. No. 6,691,897, provides many of the same functions and advantages of the present invention, it does so in a rather disjointed manner that virtually encourages the users to physically handle the exterior of the various dispensing modules that are incorporated therein which is contrary to the focus of the present invention which is intended to discourage such potential for cross-contamination by excessive handling of the individual dispensing components.

As a consequence of the foregoing situation, there has existed a longstanding need in both the physical fitness and healthcare fields for a new and improved multi-function sanitizing system that is self-contained in a uniquely designed manner to provide centralized access to a variety of cleaning and sanitizing supplies, and the provision of such an arrangement is the stated objective of the present invention.

BRIEF SUMMARY OF THE INVENTION

Briefly stated, the multi-function sanitation system that forms the basis of the present invention comprises in general an elongated housing member having interior shelves and access openings which cooperate with a hinged lid member and front door panel to store a variety of cleaning and sanitizing supplies such as anti-bacterial liquids, paper towels, tissues, and spray cleaners, as well as, a removable trash receptacle.

As will be explained in greater detail further on in the specification, the housing member has an elongated rear panel the upper end of which terminates in an open vertical framework that can serve either as a handle element and/or bracket to display advertising or the like wherein, the lower end of the rear panel terminates in an outwardly extending base.

In addition, a pair of side panels project outwardly from the rear panel and project upwardly from the base member wherein, one of the side panels has an arcuate front panel hingedly connected thereto and wherein, the upper portion of the rear panel has a cover element pivotally connected thereto.

Furthermore, the housing member further includes an interior vertical panel having rearwardly directed segments that form intermediate and upper shelves wherein, the intermediate shelf serves as a divider for an elongated opening formed in the other side panel, and the upper shelf has a vertical support arm that is aligned with a contoured aperture provided in the face of the front panel.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
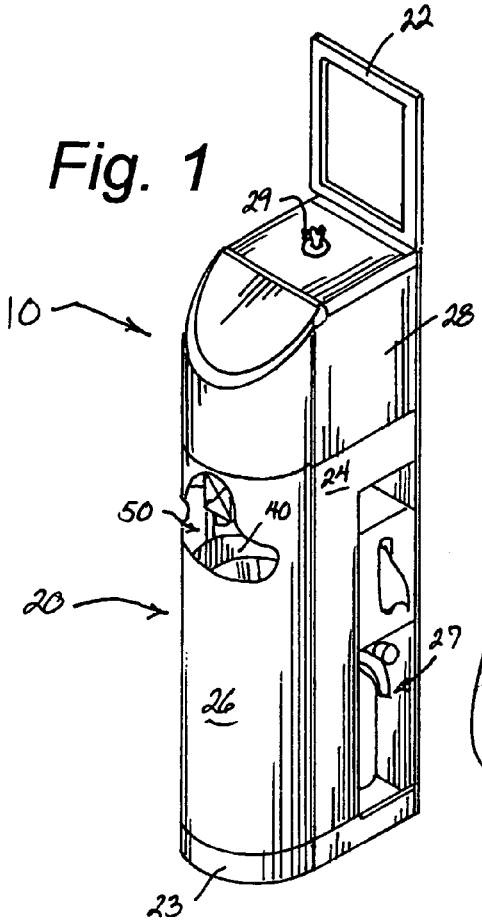
FIG. 1 is a closed perspective view of the multi-function sanitization system that forms the basis of the present invention.

As can be seen by reference to the drawings, and in particular to FIG. 1, the multi-function sanitization system that forms the basis of the present invention is designated generally by the reference number 10. The sanitization system 10 comprises in general an elongated housing member 20 the structural components of which will now be described in seriatim fashion.

Figure 2:
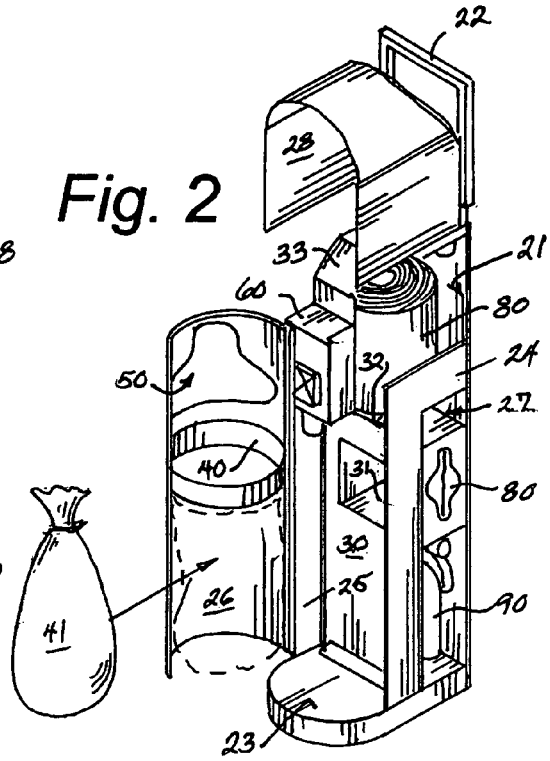
FIG. 2 is an open perspective view of the first version of the preferred embodiment of this invention.
Figure 3:
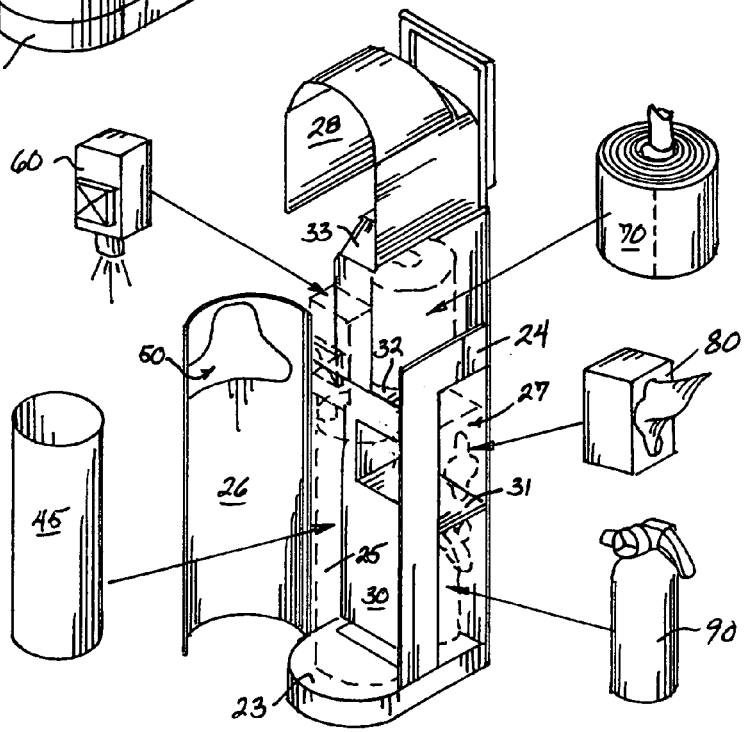
FIG. 3 is an open perspective view of the second versions of the preferred embodiment of this invention.

As shown in FIGS. 2 and 3, the housing member 20 includes an elongated rear panel 21 having an upper end that terminates in an open framework element 22 that can serve either as a handle or a bracket for advertising and having a lower end that terminates in an outwardly projecting base 23.

In addition the housing member 20 further includes a pair of side panels 24 25 wherein, one of the side panels 25 is provided with an arcuate front panel 26 that is hingedly connected thereto and the other side panel 24 is provided with an elongated opening 27 the purpose and function of which will be explained in greater detail further on in the specification.

Still referring to FIGS. 2 and 3, it can be seen that the housing member 20 further includes a cover element 28 that is pivotally connected to the rear panel 21 and disposed in an overlapping relationship with the pivoted front panel 26 and further includes a dispensing funnel 29 that allows pre-moistened antibacterial sheets to be dispensed from the interior of the housing member 20 as depicted in FIG. 1.

As can also be appreciated by reference to FIGS. 2 and 3, the housing member 20 is further provided with an interior vertical panel 30 that extends between the side panels 24 25 and has rearwardly directed segments that form intermediate 31 and upper 32 shelves wherein, the upper shelf 32 is further provided with an upwardly extending support arm 33 the purpose and function of which will be explained presently.

Turning now to FIG. 2 in particular, it can be seen that in the first version of the preferred embodiment, the front panel 26 of the housing member 20 is provided with a retention ring 40 for receiving a removable trash bag 41 whereas, in the second version of the preferred embodiment depicted in FIG. 3, a removable cylindrical trash receptacle 45 is provided in lieu of the retention ring 40 and trash bag 41 arrangement.

As can also be seen by reference to FIGS. 2 and 3, in both versions of the preferred embodiment, the front panel 26 of the housing member 20 is further provided with an enlarged contoured aperture 50 that is aligned with the vertical support arm 33 of the interior vertical panel 30 wherein, the vertical support arm 33 is provided with a dispenser 60 preferably filled with an anti-microbial disinfectant or the like and also contains a notch (not shown) that allows the vertical passage of sheets from a roll of paper towels 70 as will be explained presently.

Furthermore, the upper shelf 32 supports either the dry or pre-moistened roll of paper towels 70 that may be fed through the dispensing funnel 29 and the intermediate shelf 31 creates dual compartments in the elongated opening 27 in the side panel 24 wherein, the lower compartment is dimensioned to receive a spray bottle 90 containing a cleaning solution or the like and the upper compartment is dimensioned to receive a tissue dispenser 80 or the like.

As a consequence of the foregoing situation, the housing member 20 of this invention provides a centralized multi-compartmented receptacle for a variety of sanitizing and cleaning supplies that are required on a frequent and repetitive basis in both a healthcare and physical fitness environment.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A multi-function sanitization system for storing and dispensing a variety of cleaning and/or disinfecting supplies including anti-bacterial solutions, paper towels, tissues, spray cleaners and the like wherein, the sanitization system comprises:

a housing member including a rear panel, a base, a pair of side panels and an interior vertical panel connected to one another wherein, one of the side panels has a front panel hingedly connected thereto and the rear panel has a cover element hingedly connected thereto;

wherein, said cover element is disposed in an overlapping relation relative to said front panel; and wherein, the other side panel is provided with an elongated vertical opening.

2. The sanitization system as in claim 1; wherein, said interior vertical panel has a pair of inwardly directed segments defining an upper and an intermediate shelf wherein, said intermediate shelf divides the elongated vertical opening into separate compartments.

3. The sanitization system as in claim 2; wherein, said front panel is provided with an aperture that is in open communication with said upper shelf.

4. The sanitization system as in claim 3; wherein, said interior vertical panel is further provided with an upwardly extending support arm adapted to support a fluid dispenser.

5. The sanitization system as in claim 4; wherein, the front panel is further provided with a trash bag retention ring disposed adjacent to said aperture in the front panel.

6. The sanitization system as in claim 4 further comprising a trash receptacle dimensioned to be received between said front panel and said interior vertical panel.

7. The sanitization system as in claim 6; wherein, the rear panel has an upper end that terminates in an open framework.

8. The sanitization system as in claim 7; wherein, said upper shelf is dimensioned to receive a roll of paper towels.

9. The sanitization system as in claim 8; wherein, the compartments defined by the intermediate shelf and the elongated opening in said other side panel are dimensioned to selectively receive a spray cleaner and a supply of tissues.

10. The sanitization system as in claim 1; wherein, said cover element is provided with a dispensing funnel that allows paper towels to be withdrawn from the interior of the housing member.

11. A multi-function sanitization system for storing and dispensing a variety of cleaning and/or disinfecting supplies including anti-bacterial solutions, paper towels, tissues, spray cleaners and the like wherein, the sanitization system comprises:

a housing member including a rear panel, a base, a pair of side panels and an interior vertical panel connected to one another wherein, one of the side panels has a front panel hingedly connected thereto;

wherein, the other side panel is provided with an elongated vertical opening; and wherein, said interior vertical panel has a pair of inwardly directed segments defining an upper and an intermediate shelf wherein, said intermediate shelf divides the elongated vertical opening into separate compartments.

12. The sanitization system as in claim 11; wherein, said front panel is provided with an aperture that is in open communication with said upper shelf.

13. The sanitization system as in claim 12; wherein, said interior vertical panel is further provided with an upwardly extending support arm adapted to support a fluid dispenser.

14. The sanitization system as in claim 13; wherein, the front panel is further provided with a trash bag retention ring disposed adjacent to said aperture in the front panel.

15. The sanitization system as in claim 13 further comprising a trash receptacle dimensioned to be received between said front panel and said interior vertical panel.

16. The sanitization system as in claim 15; wherein, the rear panel has an upper end that terminates in an open framework.

17. The sanitization system as in claim 7; wherein, said upper shelf is dimensioned to receive a roll of paper towels.

18. The sanitization system as in claim 17; wherein, the compartments defined by the intermediate shelf and the elongated opening in said other side panel are dimensioned to selectively receive a spray cleaner and a supply of tissues.

19. The sanitization system as in claim 10; wherein, a dispensing funnel is provided for allowing paper towels to be withdrawn from the interior of the housing member.

* * * * *